US010851315B1

(12) United States Patent
Lapinski et al.

(10) Patent No.: US 10,851,315 B1
(45) Date of Patent: Dec. 1, 2020

(54) PROCESSES FOR INCREASING AN OCTANE VALUE OF A GASOLINE COMPONENT

(71) Applicant: UOP LLC, Des Plaines, IL (US)

(72) Inventors: Mark P. Lapinski, Aurora, IL (US); Rajeswar Gattupalli, Buffalo Grove, IL (US); Bryan K. Glover, Algonquin, IL (US); Mohamed Shakur, Hoffman Estates, IL (US); Keith A. Couch, Arlington Heights, IL (US); Michael W. Penninger, Chicago, IL (US); Soumendra Mohan Banerjee, New Delhi (IN); Deepak Bisht, New Delhi (IN); Gautam Pandey, Haryana (IN); Amit Sharma, Rajasthan (IN); Priyesh Jayendrakumar Jani, Haryana (IN); Nishesh Garg, Chandigarh (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/454,506

(22) Filed: Jun. 27, 2019

(51) Int. Cl.
*C10G 63/06* (2006.01)
*C10G 35/04* (2006.01)

(52) U.S. Cl.
CPC ..... *C10G 63/06* (2013.01); *C10G 35/04* (2013.01); *C10G 2300/1044* (2013.01); *C10G 2300/4081* (2013.01); *C10G 2400/02* (2013.01)

(58) Field of Classification Search
CPC ..... C10G 63/06; C10G 35/04; C10G 2300/1044; C10G 2300/4081; C10G 2400/02
See application file for complete search history.

(56) References Cited

U.S. PATENT DOCUMENTS 3,699,035 A * 10/1972 Hughes ..... C10G 35/085 208/92
3,718,576 A * 2/1973 Hughes ..... C10G 59/02 208/93
7,612,246 B2 * 11/2009 Broutin ..... C10L 1/06 585/737
8,470,165 B2 6/2013 Cosyns et al.
9,024,097 B2 5/2015 Serban et al.
9,029,618 B2 5/2015 Serban et al.
9,079,817 B2 7/2015 Moser et al.
(Continued)

FOREIGN PATENT DOCUMENTS

GB 1186095 4/1970

*Primary Examiner* — Randy Boyer
*Assistant Examiner* — Juan C Valencia

(57) ABSTRACT

Processes for the production of a gasoline blend. A $C_7$ portion of a naphtha stream is first isomerized to increase the branched, iso-paraffins, and then, the isomerized effluent is passed to a dehydrogenation reaction zone. In the dehydrogenation zone, the $C_7$ saturated hydrocarbons are convert to $C_7$ olefins. The $C_7$ olefins have a higher octane number than the $C_7$ saturated hydrocarbons, and the branched olefins have a higher octane number than the normal olefins. The $C_7$ olefins can be blended in a gasoline pool. $C_5$ and $C_6$ hydrocarbons can be isomerized and dehydrogenated as well, separately or with the $C_7$ components.

19 Claims, 9 Drawing Sheets

(56) References Cited

U.S. PATENT DOCUMENTS

| | | | | |
|---|---|---|---|---|
| 2006/0270885 | A1* | 11/2006 | Boyer | C07C 5/2791<br>585/741 |
| 2013/0158320 | A1 | 6/2013 | Moser et al. | |
| 2014/0378700 | A1 | 12/2014 | Majumder et al. | |

* cited by examiner

PROCESSES FOR INCREASING AN OCTANE VALUE OF A GASOLINE COMPONENT

FIELD OF THE INVENTION

This invention relates generally to a process for producing high octane gasoline and more particularly to processes which incorporate an isomerization zone and a dehydrogenation zone in series to increase the octane value of gasoline components by isomerizing and dehydrogenating $C_5$-$C_8$ saturated hydrocarbons to olefins.

BACKGROUND OF THE INVENTION

Gasoline specifications are becoming stricter and more difficult for refiners to meet. For hydrocracker-based refineries, which rely on the reforming and isomerization units to produce gasoline, it is difficult to meet the aromatics specifications in the Euro V gasoline standard while maximizing 95 RON (research octane number). Euro V standards limit gasoline to concentrations of no more than 35 lv % aromatics and no more than 1.0 lv % benzene with additional limitations on distillation and Reid vapor pressure (RVP). It is common that a refiner cannot process as much reformer feed due to the aromatics limitation thus resulting in the need to sell heavy naphtha that has lower value, thereby reducing the refiner's profitability. A refiner can add oxygenates such as methyl tert-butyl ether (MTBE) or tertiary amyl methyl ether (TAME) to the gasolines to increase octane, but these can be expensive and there may be additional environmental regulations against these compounds. The Euro V specifications also limit the amount of olefins that can be added to the gasolines to 18 lv %. For hydrocracker-based, condensate-based or other refineries that do not add a significant amount of olefins to the gasolines, producing an olefin stream can be advantageous due to an increase in octane over paraffins. Since these refineries have low olefins in their gasolines, a significant amount of olefins can be blended into the gasoline up to the specification limit.

In a typical naphtha complex configuration, a naphtha splitter distillation column fractionates a hydrotreated full range naphtha stream into light naphtha and heavy naphtha. The light naphtha, containing $C_5$ and $C_6$ species, goes to the isomerization unit to make an isomerate and the $C_7$+ heavy naphtha is processed in the reforming unit to make reformate. It would be desirable to increase the octane value of components from the heavy stream so that they can be used in the gasoline pool instead of, as discussed above, being sold as a lower value chemical or requiring additional components. It would also be desirable to further increase the octane of the light components thus reducing the octane upgrade requirements of the heavy stream and enabling more of the heavy naphtha to be processed in the reforming unit to lower product octane and lower product aromatics content.

SUMMARY OF THE INVENTION

In the present invention, a $C_7$ stream is fractionated from the naphtha splitter and first processed in an isomerization zone forming an effluent with increased isoparaffins, and then processed in a dehydrogenation zone that partially converts paraffins, isoparaffins, and cyclopentane compounds to higher octane mono-olefins. An advantage of dehydrogenation of iso-paraffins versus n-paraffins is that many of the product iso-olefins have higher octanes than the product normal olefins.

By fractionating and increasing the octane of the $C_7$ hydrocarbons via isomerization followed by dehydrogenation, the $C_7$ hydrocarbons are not converted to aromatics in the reformer. In a reformer, all types of $C_7$ hydrocarbons can be converted to aromatics; for example, $C_7$ paraffins and isoparaffins can be cyclized to aromatics, $C_7$ cyclopentanes can be isomerized to MCH and dehydrogenated to toluene, and MCH can be directly dehydrogenated to toluene. In various embodiments of the current invention, a significant portion of the $C_7$ paraffins, $C_7$ isoparaffins, and $C_7$ cyclopentanes are prevented from forming aromatics. The $C_7$ fractionated stream and isomerized effluent can contain some MCH which will be dehydrogenated to toluene. However, in the current invention, a significant portion of the $C_7$ hydrocarbons types are not converted to aromatics. By reducing the amount of aromatics formed and increasing the $C_7$ hydrocarbon octanes via isomerization followed by dehydrogenation to olefins, a larger amount of gasoline that meets the Euro V specifications can be produced and the amount of lower value heavy naphtha that needs to be sold is reduced. There is also hydrogen generated by the dehydrogenation unit that can be recirculated to the reformer or other process units. As part of the current invention, $C_5$, $C_6$, or $C_8$ paraffins, isoparaffins and cyclopentane compounds can be included in the $C_7$ feed stream to the dehydrogenation unit. These additional compounds may be fractionated from the naphtha splitter column or may be purchased. In some embodiments, these fractionated or purchased streams can be processed in separate isomerization zones followed by dehydrogenation zones to produce $C_5$, $C_6$, and $C_8$ olefin-containing stream which can be subsequently added to the gasoline pool up to the olefin specification.

An additional advantage of processing a $C_7$ stream in a $C_7$ isomerization zone followed by a $C_7$ dehydrogenation zone is that the required conversions in the dehydrogenation zone are reduced when target product octanes of about 80 RON are desired. By reducing the required $C_7$ conversion required in the dehydrogenation zone, the present invention reduces the need for multiple dehydrogenation stages with reheating between and provides for longer cycles lengths thus eliminating the need for continuous regeneration or frequent catalyst change-outs. Additionally, the lower required conversions in the $C_7$ dehydrogenation zone reduce $C_5$+ yield losses and reduce the selectivity to diolefins which are known to be very reactive in promoting gum formation in gasolines, especially in the presence of olefins. While the addition of the isomerization zone upstream of the dehydrogenation zone will increase the investment costs, the additional costs can be minimized by utilizing a single $C_7$ isomerization reactor that is hydrogen once-through and hydrocarbon once-through. The elimination of a distillation column for recycling of n-heptane, methyl-hexanes and $C_7$ cyclic hydrocarbons back to the isomerization zone will also reduce the equipment costs.

Therefore, the present invention may be characterized, in at least one aspect, as providing a process for the production of a gasoline blend by: separating a naphtha feed into a $C_5$ stream comprising $iC_5$, a stream comprising $C_6$ hydrocarbons, a $C_7$ stream comprising $C_7$ hydrocarbons, and a heavy stream comprising $C_8$ and heavier hydrocarbons; isomerizing, in a $C_6$ isomerization zone at isomerization conditions, at least a portion of the stream comprising $C_6$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and forming the gasoline blend by blending at least to: the $C_5$ stream comprising $iC_5$, the $C_6$ isomerization effluent, the $C_7$ isomerized dehydrogenation effluent, and the reformate stream.

In a second aspect, the present invention may be broadly characterized as providing a process for production of a gasoline blend by: separating a naphtha feed into a $C_5$ stream comprising $iC_5$, a stream comprising $C_6$ and $nC_5$ hydrocarbons, a $C_7$ stream comprising $C_7$ hydrocarbons, and a heavy stream comprising $C_8$ and heavier hydrocarbons; isomerizing, in a $C_6$ isomerization zone at isomerization conditions, the stream comprising $C_6$ and $nC_5$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and forming the gasoline blend by blending the $C_5$ stream comprising $iC_5$, a portion of the $C_6$ isomerization effluent, the $C_7$ isomerized dehydrogenation effluent, and the reformate stream.

In a third aspect, the present invention may be broadly characterized as providing a process for production of a gasoline blend by: separating a naphtha feed into a $C_5$ stream comprising $nC_5$ and $iC_5$, a stream comprising $C_6$ hydrocarbons, a $C_7$ stream comprising $C_7$ hydrocarbons, and a heavy stream comprising $C_8$ and heavier hydrocarbons; isomerizing the $C_5$ stream in a $C_5$ isomerization zone to produce an effluent with an increased level of $iC_5$ hydrocarbons; passing the $C_5$ isomerized effluent to a $C_5$ dehydrogenation zone configured to provide a $C_5$ isomerized dehydrogenated effluent; and, isomerizing, in a $C_6$ isomerization zone at isomerization conditions, at least a portion of the stream comprising $C_6$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and forming the gasoline blend by blending at least a portion of the $C_5$ isomerized dehydrogenated effluent, a portion of the $C_6$ isomerization effluent, and the $C_7$ isomerized dehydrogenation effluent.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

Figure 1:
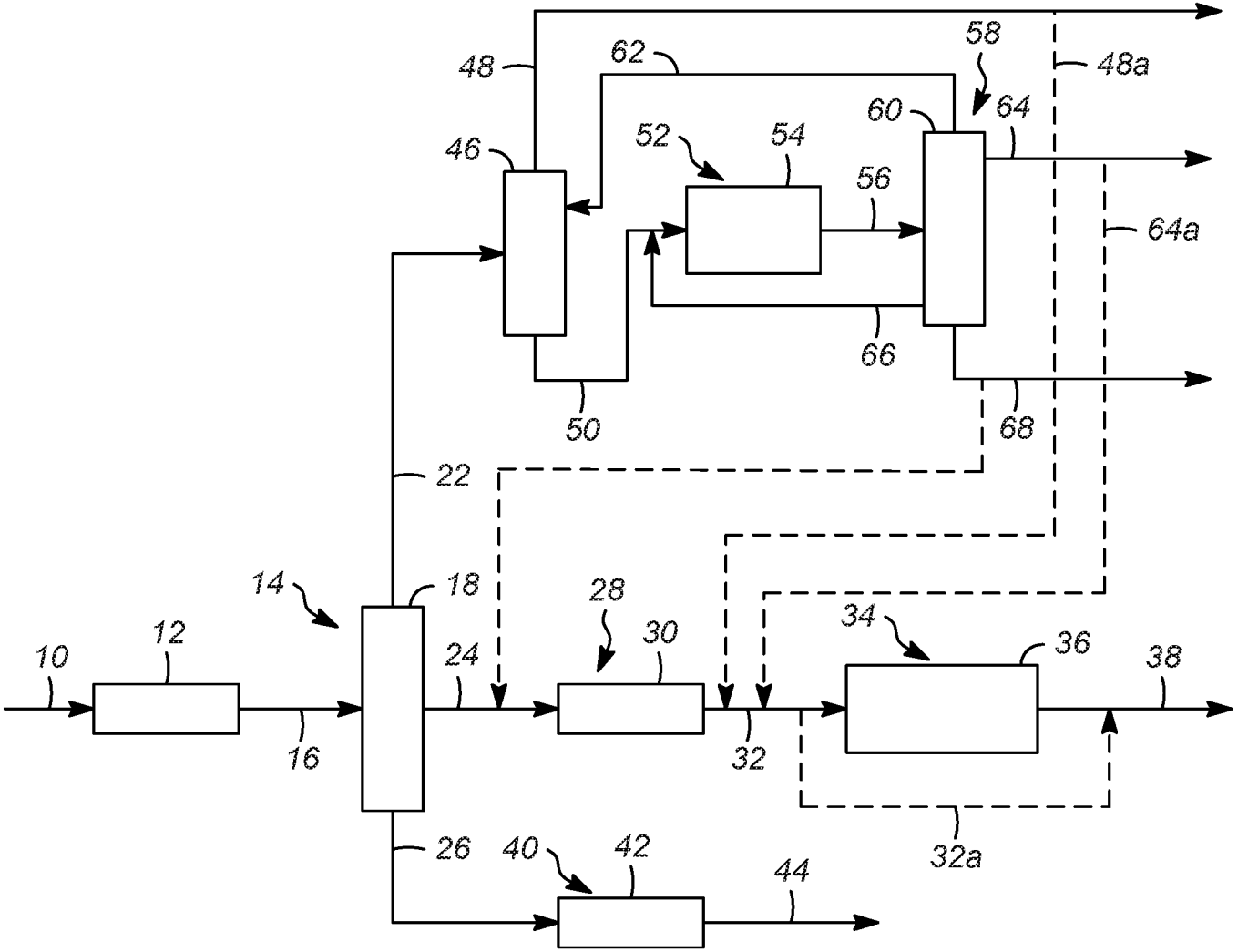
FIG. 1 shows a process flow diagram according to an exemplary process of the present invention.

As mentioned above, processes have been invented for the effective and efficient dehydrogenation of a $C_7$ naphtha cut by first passing the $C_7$ naphtha cut to a $C_7$ isomerization reactor. Generally, in the present processes, the $C_7$ cut from the naphtha splitter is first processed in a $C_7$ isomerization single reactor on a hydrogen and hydrocarbon once-through basis. The $C_7$ isomerization reactor may contain a chlorided alumina catalyst but other isomerization catalysts can be used such as sulfated zirconia catalyst or zeolite-containing catalyst but these may require a recycle gas compressor to maintain high Hz/hydrocarbon ratios. The conversions in the isomerization reactor are preferably controlled to minimize yield losses but enough to produce isomerates with octanes in the range of 65-75 RON. The effluent of the isomerization zone is then passed to a once-through $C_7$ dehydrogenation unit to increase the octane to about 80 RON via dehydrogenation of normal and iso-paraffins to the corresponding normal and branched mono-olefins, dehydrogenation of cyclopentanes to olefinic cyclopentanes, and dehydrogenation of cyclohexanes into aromatics. The $C_7$ dehydrogenation conversions needed are lower since the octane boost required is reduced when processing a $C_7$ isomerate stream. A selective hydrogenation unit can be added after the dehydrogenation unit for selective hydrogenation of conjugated diolefins to mono-olefins.

With these general principles in mind, one or more embodiments of the present invention will be described with the understanding that the following description is not intended to be limiting. Additionally, in the various Figures, identical elements in the various embodiments have identical reference numbers.

As shown in the Figures, a naphtha feed stream 10 comprising $C_4$-$C_{12}$ hydrocarbons may be first treated in, for example, a hydrotreating unit 12 before being separated in a fractionation zone 14.

Hydrotreating is a process in which hydrogen gas is contacted with a hydrocarbon stream in the presence of suitable catalysts which are primarily active for the removal of heteroatoms, such as sulfur, nitrogen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $h^{-1}$ to about 4 $h^{-1}$, and a hydrogen rate of about 168 to about 1,011 $Nm^3/m^3$ oil (1,000-6,000 scf/bbl). Typical hydrotreating catalysts include at least one Group VIII metal, preferably iron, cobalt and nickel, and at least one Group VI metal, preferably molybdenum and tungsten, on a high surface area support material, preferably alumina.

Other typical hydrotreating catalysts include zeolitic catalysts, as well as noble metal catalysts where the noble metal is selected from palladium and platinum. Light ends and contaminant gases are typically removed in a stripper (not shown) from the hydrotreated effluent 16.

The hydrotreated effluent 16 is passed to the fractionation zone 14 which comprises at least one fractionation column 18, which may be a naphtha splitter. In the fractionation column 18, the components of the naphtha feed stream 10 (or hydrotreated effluent 16) are separated into at least a $C_6$ stream 22, a $C_7$ stream 24, and a heavy stream 26. The $C_6$ rich stream 22 comprises $C_6$ and lighter boiling hydrocarbons, the $C_7$ stream 24 comprises $C_7$ hydrocarbons, and the heavy stream 26 comprises $C_8$ and heavier hydrocarbons.

The $C_7$ stream 24 can include cyclohexane and methylcyclohexane but these should be controlled in the fractionation zone 14 depending on the refiner's plans to meet the aromatic specifications in the gasoline blends. The cyclohexane and methylcyclohexane remaining after the isomerization zone will dehydrogenate to benzene and toluene in the dehydrogenation zone, respectively. If there are large concentrations of cyclohexanes in the feed to the dehydrogenation zone, rapid dehydrogenation and the quenching of other dehydrogenation reactions can occur due to a large endothermic temperature drop. Concentrations less than about 1.5 wt % cyclohexane and less than about 7.5 wt % MCH are preferred and concentrations less than about 2.5 wt % MCH are more preferred. The refiner can increase these levels in the dehydrogenation feed if desired based on the total aromatics produced in all of the streams that are blended in the gasolines in order to meet the aromatic limits.

The $C_7$ stream 24 is passed to a $C_7$ isomerization zone 28. The $C_7$ isomerization zone 28 comprises at least one reactor 30 with an isomerization catalyst and is operated under conditions for converting normal and single branched paraffins in the $C_7$ stream 24 into multi-branched paraffins. Additionally, within the $C_7$ isomerization zone 28 some $C_7$ cyclopentanes and MCH may also be isomerized.

Any suitable isomerization catalyst may be used in the $C_7$ isomerization zone 28. Suitable isomerization catalysts include acidic catalysts using chloride for maintaining the sought acidity and sulfated catalysts. The isomerization catalyst may be amorphous, e.g., based upon amorphous alumina, or zeolitic. A zeolitic catalyst would still normally contain an amorphous binder. The catalyst may include a sulfated zirconia and platinum as described in U.S. Pat. No. 5,036,035 and European application 0 666 109 or a platinum group metal on chlorided alumina as described in U.S. Pat. Nos. 5,705,730 and 6,214,764. Another suitable catalyst is described in U.S. Pat. No. 5,922,639. U.S. Pat. No. 6,818,589 discloses a catalyst including a tungstated support of an oxide or hydroxide of a Group IVB (TUPAC 4) metal, for example zirconium oxide or hydroxide, at least a first component which is a lanthanide element and/or yttrium component, and at least a second component being a platinum-group metal component.

Contacting within the reactor 30 of the isomerization zone 28 may be effected using the catalyst in a fixed-bed system, a moving-bed system, a fluidized-bed system, or in a batch-type operation. A fixed-bed system may be employed in an exemplary embodiment. The reactants may be contacted with the bed of catalyst particles in upward, downward, or radial-flow fashion. The reactants may be in the liquid phase, a mixed liquid-vapor phase, or a vapor phase when contacted with the catalyst particles. Zone 28 can include one or more isomerization reactors 30, as well as feed-effluent heat exchangers, inter-reactor heat exchangers, driers, sulfur guards, separator, stabilizer, compressors, separation columns, recycle streams and other equipment as known in the art (not shown). A hydrogen-rich gas stream (not shown) is typically mixed with stream 24 and heated to reaction temperatures. The hydrogen-rich gas stream, for example, comprises about 50-100 mol % hydrogen. The hydrogen can be separated from the reactor effluent, compressed and recycled back to mix with the light stream. Stream 24 and hydrogen are contacted in the $C_7$ isomerization zone 28 with an isomerization catalyst forming a $C_7$ isomerization effluent 32.

Isomerization conditions within the reactor 30 of the isomerization zone 28 may include reactor temperatures ranging from 40 to 250° C. (104 to 482° F.). Lower reaction temperatures (within the stated range) may be employed in order to favor equilibrium mixtures having the highest concentration of high-octane highly branched isoalkanes and to minimize cracking of the feed to lighter hydrocarbons. Temperatures from 100 to 200° C. (212 to 392° F.) may be employed in some embodiments. Reactor operating pressures may be 100 kPa to 10 MPa absolute (14.5 to 1,450 psi), for example from 0.5 MPa to 4 MPa absolute (72.5 to 580 psi). Liquid hourly space velocities may be from 0.2 to 25 volumes of isomerizable hydrocarbon feed per hour per volume of catalyst, for example from 0.5 to 15 $hr^{-1}$.

A $C_7$ isomerized effluent 32 is combined with a hydrogen stream (not shown), heated, and passed to a $C_7$ dehydrogenation zone 34. The $C_7$ dehydrogenation zone 34 comprises a reactor 36 which contains a catalyst to convert a portion of the saturated hydrocarbons in the $C_7$ isomerized effluent 32 to olefins in the presence of hydrogen over a selective dehydrogenation catalyst. Specifically, normal paraffins are dehydrogenated to the corresponding normal mono-olefins. For example, normal-heptane is dehydrogenated to the mono-olefins 1-heptene, trans-2-heptene, trans-3-heptene, cis-2-heptene, and cis-3-heptene. Isoparaffins are dehydrogenated to the corresponding mono-iso-olefins. For example, 2,4-dimethylpentane is dehydrogenated to 2,4-dimethyl-1-pentene and 2,4-dimethyl-2-pentene. Cyclopentane compounds are dehydrogenated to cyclopentene compounds. Cyclohexane compounds are dehydrogenated to aromatic compounds.

The dehydrogenation process may utilize any suitable selective dehydrogenation catalyst. Generally, one preferred suitable catalyst comprises a Group VIII noble metal component (e.g., platinum, iridium, rhodium, and palladium), an alkali metal component, and a porous inorganic carrier material. The catalyst may also contain promoter metals which advantageously improve the performance of the catalyst. The porous carrier material should be relatively refractory to the conditions utilized in the reaction zone and may be chosen from those carrier materials which have traditionally been utilized in dual function hydrocarbon conversion catalysts. A preferred porous carrier material is a refractory inorganic oxide, with the most preferred an alumina carrier material. The particles are usually spheroidal and have a diameter of from about 1.6 to about 3.2 mm (about 1/16 to about 1/8 inch), although they may be as large as about 6.4 mm (about 1/4 inch). Newer dehydrogenation catalysts can also be used in this process.

For example, one such catalyst comprises a layered catalyst composition comprising an inner core, and outer layer bonded to the inner core so that the attrition loss is less than 10 wt % based on the weight of the outer layer. The outer layer is a refractory inorganic oxide. Uniformly dispersed on the outer layer is at least one platinum group metal, and a promoter metal. The inner core and the outer layer are made of different materials. A modifier metal is also dispersed on the outer layer. The inner core is made from alpha alumina, theta alumina, silicon carbide, metals, cordierite, zirconia, titania, and mixtures thereof. The outer refractory inorganic oxide is made from gamma alumina, delta alumina, eta alumina, theta alumina, silica/alumina, zeolites, non-zeolitic molecular sieves, titania, zirconia, and mixtures thereof. The platinum group metals include platinum, palladium, rhodium, iridium, ruthenium, osmium, and mixtures thereof. The platinum group metal is present in an amount from about 0.01 to about 5 wt % of the catalyst composition. The promoter metal includes tin, germanium, rhenium, gallium, bismuth, lead, indium, cerium, zinc, and mixtures thereof. The modifier metal includes alkali metals, such as potassium and lithium, alkaline earth metals, and mixtures thereof. Further discussion of two layered dehydrogenation catalysts can be found in U.S. Pat. No. 6,617,381, which is incorporated herein by reference, for example. Additionally, contacting within the dehydrogenation zone 34 may be accomplished using the catalyst in a fixed-bed system, a moving-bed system, a fluidized-bed system, or in a batch-type operation.

The process conditions utilized for dehydrogenation are usually 0 to 345 kPa (0 to 50 psig), 0.5 to 6 hydrogen/hydrocarbon mole ratio, inlet reactor temperatures of 450 to 600° C. (845 to 1112° F.), and 1 to 30 $h^{-1}$ LHSV. Conditions preferred for $C_7$ hydrocarbon feed stocks are 138 to 276 kPa (20 to 40 psig), about 3 to 5 hydrogen/hydrocarbon mole ratio, inlet reactor temperatures of about 520 to 560° C. (968 to 1040° F.), and about 5 to 10 $h^{-1}$ LHSV. Adiabatic radial-flow reactors are used to minimize pressure drop within an efficient reactor volume. Hydrogen and some by-product light ends are typically separated (not shown) from a $C_7$ dehydrogenation effluent 38, and a part of this hydrogen gas may be recycled back to the dehydrogenation reactor 36 to minimize coking and enhance catalyst stability.

The $C_7$ dehydrogenation effluent 38 comprising an increased olefins content compared to an olefins content of the $C_7$ stream 24 may be added to a gasoline pool to bolster octane value of the gasoline blend.

Although not depicted as such, the $C_7$ dehydrogenation effluent 38 may first be passed to a selective hydrogenation zone (not shown in FIG. 1) for the selective conversion of diolefins to mono-olefins. In such a process, a hydrogen stream is also charged to the selective hydrogenation reactor. Typical selective hydrogenation conditions utilized are 25 to 350° C. (77 to 662° F.), 276 kPa to 5.5 MPa (40 to 800 psig), 5-35 $h^{-1}$ LHSV and a hydrogen to diolefin mole ratio of between about 1.4 to 2.0. The selective hydrogenation reactor effluent passes to a stripper (not shown) where dissolved light hydrocarbons are removed and the stripper bottoms, a mixture of mono-olefin hydrocarbons and unconverted saturated hydrocarbons stream are sent for blending in gasoline pool. Other streams from the process are also blended to form the gasoline.

Returning to the fractionation zone 14, the heavy stream 26 from the fractionation zone 14 may be passed to a reforming zone 40. Generally, the reforming zone 40 includes a number of reactors (or reaction zones) 42, but usually the number of reactors 42 is three, four, or five. Since reforming reactions occur generally at an elevated temperature and are generally endothermic, each reactor 42 usually has associated with it one or more heating zones, which heat the reactants to the desired reaction temperature. An effluent stream 44 from the reforming zone 40 may also be blended with the $C_7$ dehydrogenation effluent 38 for the gasoline blend.

Similarly, as shown in FIG. 1, the $C_6$ rich stream 22 from the fractionation column 18 may be passed to another fractionation column 46 to separate the components into, for example, a $C_5$ stream 48 comprising $iC_5$ hydrocarbons, and a second $C_6$ stream 50 comprising $C_6$ hydrocarbons. The $C_5$ stream 48 comprising $iC_5$ hydrocarbons may be blended with the other streams for the gasoline blend.

The second $C_6$ stream 50, which in various embodiments may include, for example, $nC_5$ hydrocarbons, may be passed to a $C_6$ isomerization zone 52 where the $C_5$ and $C_6$ hydrocarbons will be isomerized. The $C_6$ isomerization zone 52 can be any type of isomerization zone that takes a stream of $C_5$ and $C_6$ straight-chain hydrocarbons or a mixture of straight-chain, branched-chain, cyclic hydrocarbons, and benzene and converts straight-chain hydrocarbons in the feed mixture to branched-chain hydrocarbons and branched hydrocarbons to more highly branched hydrocarbons, thereby producing an effluent having branched-chain and straight-chain hydrocarbons. The cycloparaffins can isomerize between cyclopentanes and cyclohexane compounds. Benzene can be saturated to form cyclohexane.

In some embodiments, the $C_6$ isomerization zone 52 can include one or more isomerization reactors 54, as well as feed-effluent heat exchangers, inter-reactor heat exchangers, driers, sulfur guards, separator, stabilizer, compressors, separation columns, recycle streams and other equipment as known in the art (not shown). A hydrogen-rich gas stream (not shown) is typically mixed with the second $C_6$ stream 50 and heated to reaction temperatures. The hydrogen-rich gas stream, for example, comprises about 50-100 mol % hydrogen. The hydrogen can be separated from the reactor effluent, compressed and recycled back to mix with the light stream. The second $C_6$ stream 50 and hydrogen are contacted in the $C_6$ isomerization zone 52 with an isomerization catalyst forming a $C_6$ isomerization effluent 56.

The catalyst that can be used in the $C_6$ isomerization zone 54 include traditional isomerization catalysts including chlorided platinum alumina, crystalline aluminosilicates or zeolites, and other solid strong acid catalysts such as sulfated zirconia and modified sulfated zirconia. Suitable catalyst compositions of this type will exhibit selective and substantial isomerization activity under the operating conditions of the process. Operating conditions within the isomerization zone are selected to maximize the production of isoalkane product from the feed components. Temperatures within the isomerization zone will usually range from about 40° to about 235° C. (100° to 455° F.). Lower reaction temperatures usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes, temperatures in the range of from about 60 to about 160° C. (140 to 320° F.) are suitable. The isomerization zone may be maintained over a wide range of pressures. Pressure conditions in the isomerization of $C_4$-$C_6$ paraffins range from about 700 kPa(a) to about 7,000 kPa(a) (102 to 1,015 psi). In other embodiments, pressures for this process are in the range of from about 2,000 kPa(g) to 5,000 kPa(g) (290 to 725 psi). The feed rate to the reaction zone can also vary over a wide range. These conditions include liquid hourly space velocities ranging from about 0.5 to about 12 $h^{-1}$ however, with some embodiments having space velocities between about 1 and about 6 $h^{-1}$.

The effluent from the $C_6$ isomerization zone 52 is passed to a fractionation zone 58 comprising, for example, a deisohexanizer column 60 to separate the effluent into a plurality of streams, including, an overhead stream 62 comprising $iC_5$ and $nC_5$, and an $iC_6$ stream 64, a recycle stream 66 comprising $nC_6$ hydrocarbons, and a bottoms stream 68 comprising $C_7$ and heavier hydrocarbons. The bottoms stream 68 and the $iC_6$ stream 64 streams may be blended to the form the gasoline blend. The overhead stream 62 may be recycled to the fractionation column 46, while the recycle stream 66 is returned to the isomerization zone 52.

When $nC_7$ is dehydrogenated to the corresponding normal $C_7$ mono-olefins, the octane numbers range between 54.5 to 90.2 RON with an average of 77.0 RON as listed in Table 1, below. When $nC_7$ is first isomerized to multi-branched $iC_7$ hydrocarbons and then dehydrogenated to the corresponding multi-branched $iC_7$ mono-olefins, the octane numbers range from 99.2 to 105.3 RON with averages of 100.2-103.1 RON. Table 1, below. Thus, the multi-branched $iC_7$ mono-olefins have significantly higher octanes than the normal $C_7$ mono-olefins. Table 2, below, shows a similar comparison for the $nC_5$ and $iC_5$ hydrocarbons and the corresponding mono-olefins. Again, the $iC_5$ mono-olefins have higher octanes than the normal $C_5$ mono-olefins.

TABLE 1

Pure component octanes (RON) for $C_7$ hydrocarbons.

| Paraffin | Corresponding Mono-Olefins | API Database RON | Phillip 66 Database RON |
|---|---|---|---|
| $nC_7$ | 1-heptene | 54.5 | 54.5 |
| | t-2-heptene | 73.4 | 73.4 |
| | t-3-heptene | 89.8 | 89.8 |
| | c-3-heptene | 90.2 | 90.2 |
| | Average | 77.0 | 77.0 |
| 2,2-DMP | 4,4-dimethyl-1-pentene | 100.4 | 105.4 |
| | 4,4-dimethyl-c-2-pentene | 100.5 | 105.3 |
| | 4,4-dimethyl-t-2-pentene | 100.5 | 105.3 |
| 2,4-DMP | 2,4-dimethyl-1-pentene | 99.2 | 99.2 |
| | 2,4-dimethyl-2-pentene | 100.0 | 100.0 |
| 3,3-DMP | 3,3-dimethyl-1-pentene | 100.3 | 103.5 |
| Average | 100.2 | 103.1 | |

TABLE 2

Pure component octanes (RON) for $C_5$ hydrocarbons

| Paraffin | Corresponding Mono-Olefins | API Database RON | Phillip 66 Database RON |
|---|---|---|---|
| $nC_5$ | 1-pentene | 90.9 | 87.9 |
| | 2-pentene | — | 87.8 |
| | Average | 90.9 | 87.9 |
| $iC_5$ | 2-methyl-1-butene | 100.2 | 98.3 |
| | 3-methyl-1-butene | — | 97.5 |
| | 2-methyl-2-butene | 97.3 | 97.3 |
| | Average | 98.8 | 97.7 |

EXAMPLES

Dehydrogenation Only

A $C_7$ fractionated cut of a hydrotreated naphtha was analyzed and found to contain 20.1 wt % n-heptane, 25.1 wt % 2-methylhexane, 31.8 wt % 3-methylhexane, 3.0 wt % 3-ethylpentane, 10.1 wt % multi-branched $C_7$ isoparaffins, 6.8 wt % $C_7$ cyclopentanes, 2.3 wt % methylcyclohexane, and 0.8 wt % cyclohexane. The octane number was estimated to be 56.3 RON.

From pilot plant data, a dehydrogenation model was formulated and placed into a process simulator to estimate the temperature drop over a single dehydrogenation reactor and the products formed. The process conditions of the dehydrogenation reactor (layered catalyst with the outer layer comprising gamma alumina with dispersed metals Pt, Sn, and Li) were set to 550° C. (1022° F.) (Case 1) and 565° C. (1049° F.) (Case 2) inlet temperature, 137.9 kPa (20 psig), 10 $h^{-1}$ LHSV, and hydrogen/hydrocarbon mole ratio of 3. Table 3, below, shows the results of the process simulations.

TABLE 3

Dehydrogenation results for $C_7$ fractionated cut.

| Dehydrogenation Case | 1 | 2 |
|---|---|---|
| Inlet Temperature, ° C. | 550 | 565 |
| Outlet Temperature, ° C. | 495 | 505 |
| $C_7$ Conversion to Olefins, % | 14.2 | 17.5 |
| $C_4$+ RON | 66.5 | 70.7 |
| Multi-branched $C_7$ Olefins, LV % | 1.4 | 1.6 |
| Single-branched $C_7$ Olefins, LV % | 8.0 | 9.8 |
| Normal $C_7$ Olefins, LV % | 2.7 | 3.3 |
| $C_7$ Cyclic Olefins, LV % | 0.8 | 2.0 |
| Toluene, LV % | 3.9 | 3.9 |
| Benzene, LV % | 0.6 | 0.6 |

Isomerization and Dehydrogenation

Additional process simulations were conducted in which the $C_7$ fractionated cut of Cases 1 and 2 was first passed through a single isomerization reactor simulation operating at 1896 kPa (275 psig), 7 $h^{-1}$ LHSV, 116° C. (241° F.) reactor inlet temperature, 0.05 hydrogen/hydrocarbon outlet mole ratio with a chlorided alumina isomerization catalyst.

The isomerized $C_5$+ liquid product was predicted to contain 11.7 wt % n-heptane, 21.3 wt % 2-methylhexane, 19.9 wt % 3-methylhexane, 1.6 wt % 3-ethylpentane, 34.3 wt % multi-branched $C_7$ isoparaffins, 2.7 wt % $C_7$ cyclopentanes, 7.1 wt % methylcyclohexane, 0.4 wt % cyclohexane and 0.4 wt % methylcyclopentane. The isomerization shifted the n-heptane and single-branched $C_7$ isoparaffins to multi-branched $C_7$ isoparaffins and some of the $C_7$ cyclopentanes to methylcyclohexane.

The isomerized product was then simulated as feed to the single dehydrogenation reactor at 550° C. (1022° F.) (Case 3) and 565° C. (1049° F.) (Case 4) inlet temperature, 137.9 kPa (20 psig), 10 $h^{-1}$ LHSV, and hydrogen/hydrocarbon mole ratio of 3. Table 4, below, shows the results of these process simulations.

TABLE 4

Dehydrogenation results for the isomerized product of the $C_7$ fractionated cut.

| Dehydrogenation Case | 3 | 4 |
|---|---|---|
| Inlet Temperature, ° C. | 550 | 565 |
| Outlet Temperature, ° C. | 483 | 492 |
| $C_7$ Conversion to Olefins, % | 10.4 | 13.6 |
| $C_4$+ RON | 73.8 | 77.8 |
| Multi-branched $C_7$ Olefins, LV % | 3.4 | 4.4 |
| Single-branched $C_7$ Olefins, LV % | 4.2 | 5.4 |
| Normal $C_7$ Olefins, LV % | 1.1 | 1.5 |
| $C_7$ Cyclic Olefins, LV % | 0.0 | 0.2 |
| Toluene, LV % | 7.6 | 7.8 |
| Benzene, LV % | 0.3 | 0.4 |

By comparing Case 3 to Case 1 and Case 4 to Case 2 from Tables 3 and 4, the calculated product octanes (based on an octane model) are higher for the combination of isomerization followed by dehydrogenation (Table 4). The additional concentrations of multi-branched $C_7$ olefins are contributing to the increased octane. The additional concentrations of toluene are also contributing to the increased octane.

Returning to FIG. 1, if the MCH content in the $C_7$ stream 24 is higher than desired for aromatics in the gasoline blends, a portion 32*a* of the isomerized effluent 32 can be routed around the dehydrogenation zone 34 thus reducing the toluene produced. In this situation, the attainable octane of the recombined product stream (stream 38) will be lower. For cases where it is desirable for the refiner to produce toluene from MCH and limit the $C_7$ olefins produced, then higher MCH contents can be sent to the dehydrogenation zone 34 where the MCH to toluene will quench other dehydrogenation reactions that form $C_7$ olefins. It is believed that in such cases, little or no di-olefins would be produced and thus, a selective hydrogenation zone would not be needed. Additionally, for this case, operating the dehydrogenation zone 34 with a reactor inlet temperature between 400 to 450° C. (752 to 842° F.) will minimize cracking and advantageously allowing for the equilibrium conversion of MCH to toluene to be achieved.

Additionally, as shown in FIG. 1 it is also contemplated that at least a portion 48*a* of the $iC_5$ stream 48 and/or a portion 64*a* of the $iC_6$ stream 64 is/are combined with the $C_7$ isomerization effluent 32. Thus, $iC_5$, $iC_6$, and $C_7$ components are passed to the $C_7$ dehydrogenation zone 34 so that the $C_7$ dehydrogenation effluent 38 contains $C_5$, $C_6$, and $C_7$ olefins with higher octane for adding to the gasoline pool.

Since $iC_5$ and $iC_6$ paraffins have been observed to exhibit lower dehydrogenation rates than n-$C_7$ and iso-$C_7$s, the $C_5$s and $C_6$s dilute the dehydrogenation feed in terms of conversion leading to a smaller endotherm. This can prevent quenching of the $C_7$ dehydrogenation reactions due to potentially high endotherms for the more reactive $C_7$ components, especially when the feed contains MCH which rapidly dehydrogenates to toluene. In addition, the $iC_5$ and $iC_6$ olefins that are formed will have high blending octane numbers thus reducing the octane upgrade requirements of the heavy stream and enabling more of the heavy naphtha to be processed in the reforming unit at lower product octane and lower product aromatics content. Further, an advantage of dehydrogenation the iso-paraffin streams 48*a* and 64*a* versus streams rich in n-paraffins is that the product iso-olefins have higher octanes than the n-olefins.

The $C_7$ dehydrogenation effluent 38, containing $C_5$-$C_6$-$C_7$ olefins, may, as discussed above, be passed to a selective hydrogenation zone (not shown) to reduce the diolefin content if desired. Additionally, it is contemplated that the $iC_5$ or $iC_6$ streams are combined in specific ratios to the $C_7$ isomerization effluent 32 (or the dehydrogenation feed) or only combining the $iC_5$-rich stream with the $C_7$ dehydrogenation feed or just combining the $iC_6$-rich stream with the $C_7$ dehydrogenation feed. In additional embodiments, other streams containing $C_5$, $C_6$, and $C_8$ paraffins, iso-paraffins, and cyclopentane compounds such as cyclopentane, methylcyclopentane and 1-methyl-1-ethyl-trimethylcyclopentane can be combined with stream 32 and fed to the dehydrogenation zone 34. The additional streams can be fractionated from the hydrotreated full range naphtha, obtained from other locations in the refinery or purchased.

Figure 2:
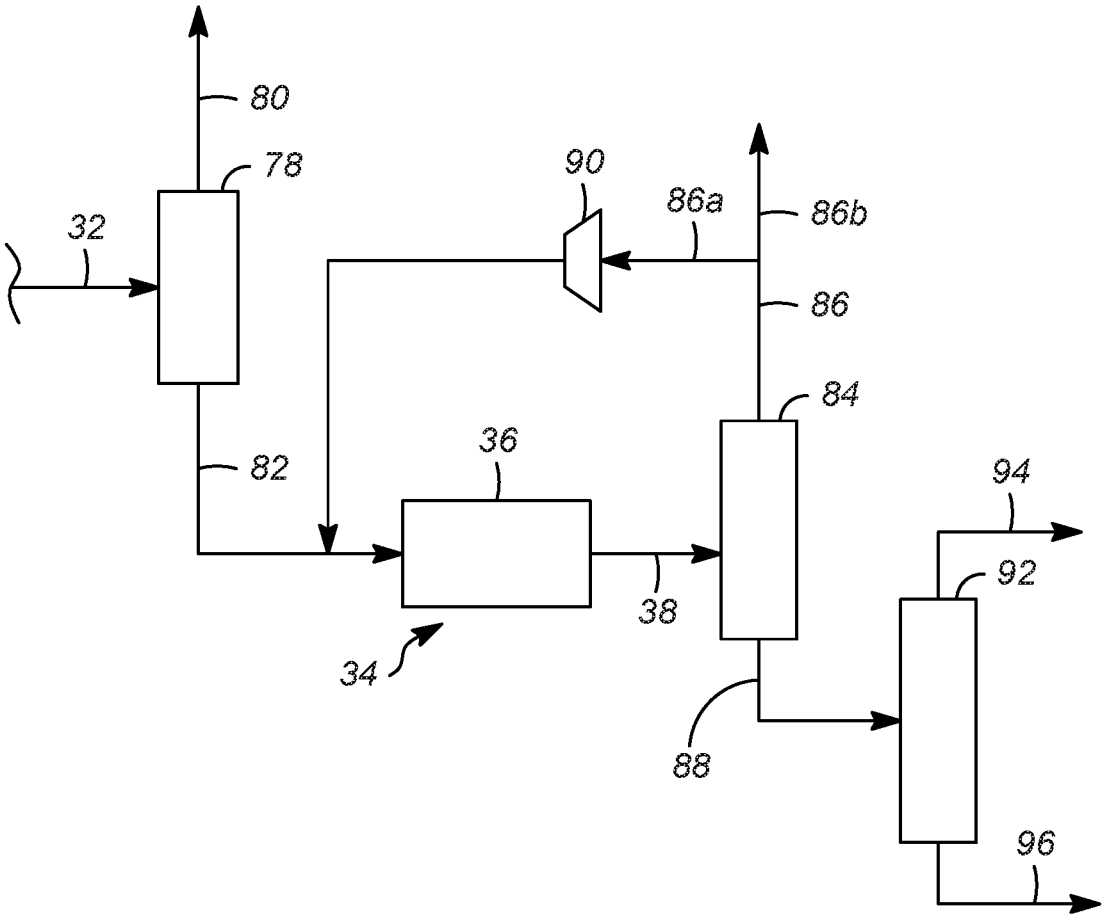
FIG. 2 shows a process flow diagram according to an exemplary process of the present invention.
Figure 3:
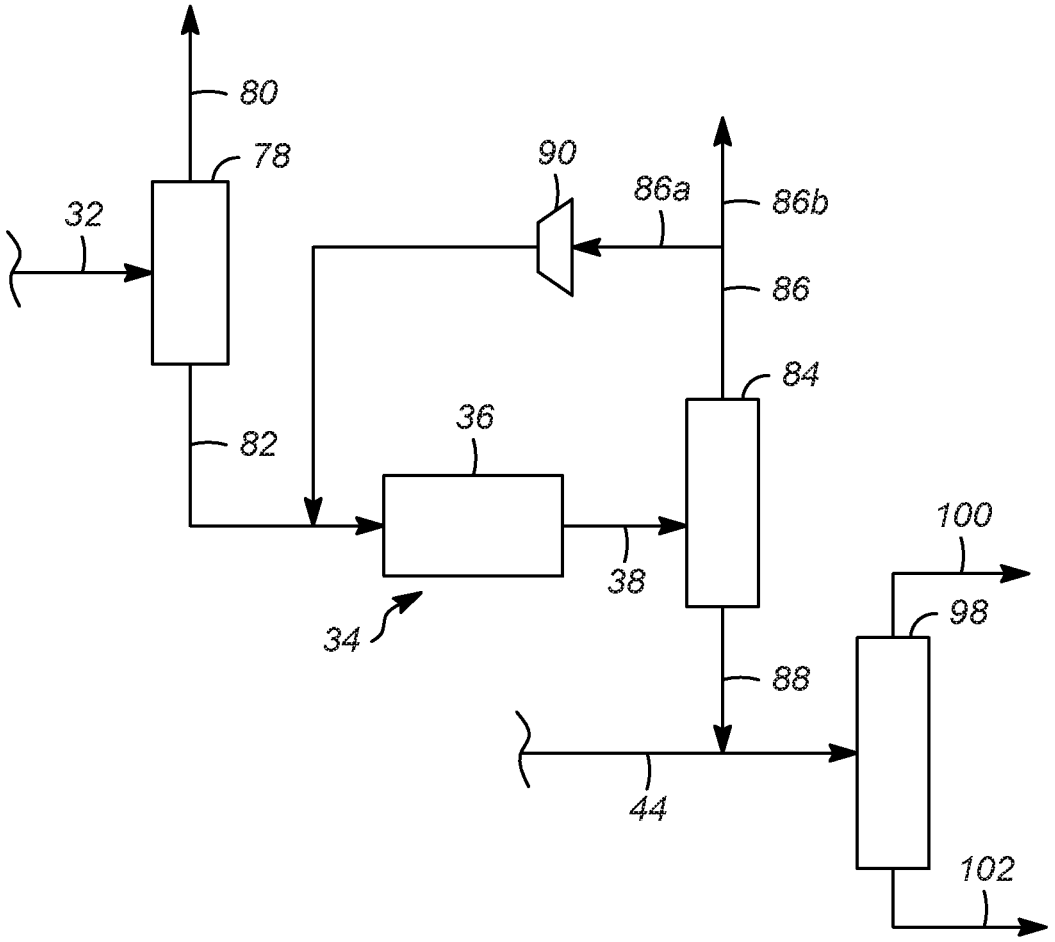
FIG. 3 shows a process flow diagram according to an exemplary process of the present invention.

Turning to FIGS. 2 and 3, more detailed flow diagrams of portions of the process shown in FIG. 1 are shown. More specifically, the details shown in FIGS. 2 and 3 are directed to hydrogen gas quality and are believed to lower the costs associated with using the $C_7$ dehydrogenation zone 34.

As shown in FIGS. 2 and 3, the $C_7$ isomerization effluent 32 is passed to a stabilizer column 78 which produces a stabilizer overhead stream 80 comprising $C_4$—, hydrogen, and HCl and a stabilizer bottoms stream 82 including the $C_7$ hydrocarbons. The stabilizer overhead stream 80 may be combined with the $C_4$— portion of the $C_6$ isomerization effluent 56 (FIG. 1) to be treated, for example, in a scrubber to remove the HCl. Thus, the need for a separate gas scrubber for the $C_7$ isomerization zone 28 is eliminated.

The stabilizer bottoms stream 82 is passed to the $C_7$ dehydrogenation zone 34, and the $C_7$ dehydrogenation effluent stream 38 is passed to a separator vessel 84 which provides a $C_7$ dehydrogenation net gas stream 86 and a separator bottoms stream 88. The $C_7$ dehydrogenation net gas stream 86 includes hydrogen, $C_1$, and $C_2$ hydrocarbons, and may also include some small amounts of $C_3$ and $C_4$ hydrocarbons. A first portion 86*a* of $C_7$ dehydrogenation net gas stream 86 may be compressed in a compressor 90 and recycled to the $C_7$ dehydrogenation zone 34. A second portion 86*b* of the $C_7$ dehydrogenation net gas stream 86 may be used in the reforming zone 40 (FIG. 1).

Specifically, in FIG. 2, the separator bottoms stream 88 may be passed to a stripper column 92 which separates the separator bottoms stream 88 into a stripper overhead stream 94 and a stripper bottoms stream 96. The stripper overhead stream 94 comprises mostly $C_4$— hydrocarbons and may be sent to the reforming zone 40 (FIG. 1). The stripper bottoms stream 96 comprises the $C_7$ hydrocarbons (and may include $iC_6$ and $iC_5$ olefins and other hydrocarbons as discussed above) and is blended in the gasoline pool.

Alternatively, in FIG. 3, the separator bottoms stream 88 is passed to a fractionation column 98, which may be a debutanizer column, and which also receives the reforming effluent 44 from the reforming zone (in FIG. 1). The fractionation column 98 separates a $C_4$— hydrocarbon stream 100 from the combined reforming effluent 44 and separator bottoms stream 88. In this embodiment, by combining the separator bottoms stream 88 with the reforming effluent 44, the stripper column 92 (from FIG. 2) is eliminated. A bottoms stream 102 from the fractionation column 98 comprises $C_5$+ materials including the $C_7$ hydrocarbons from the $C_7$ dehydrogenation zone 36. Thus, the bottoms stream 102 contains both the high-octane products from the reforming zone 40 and the high-octane products from the $C_7$ dehydrogenation zone 36.

Figure 4:
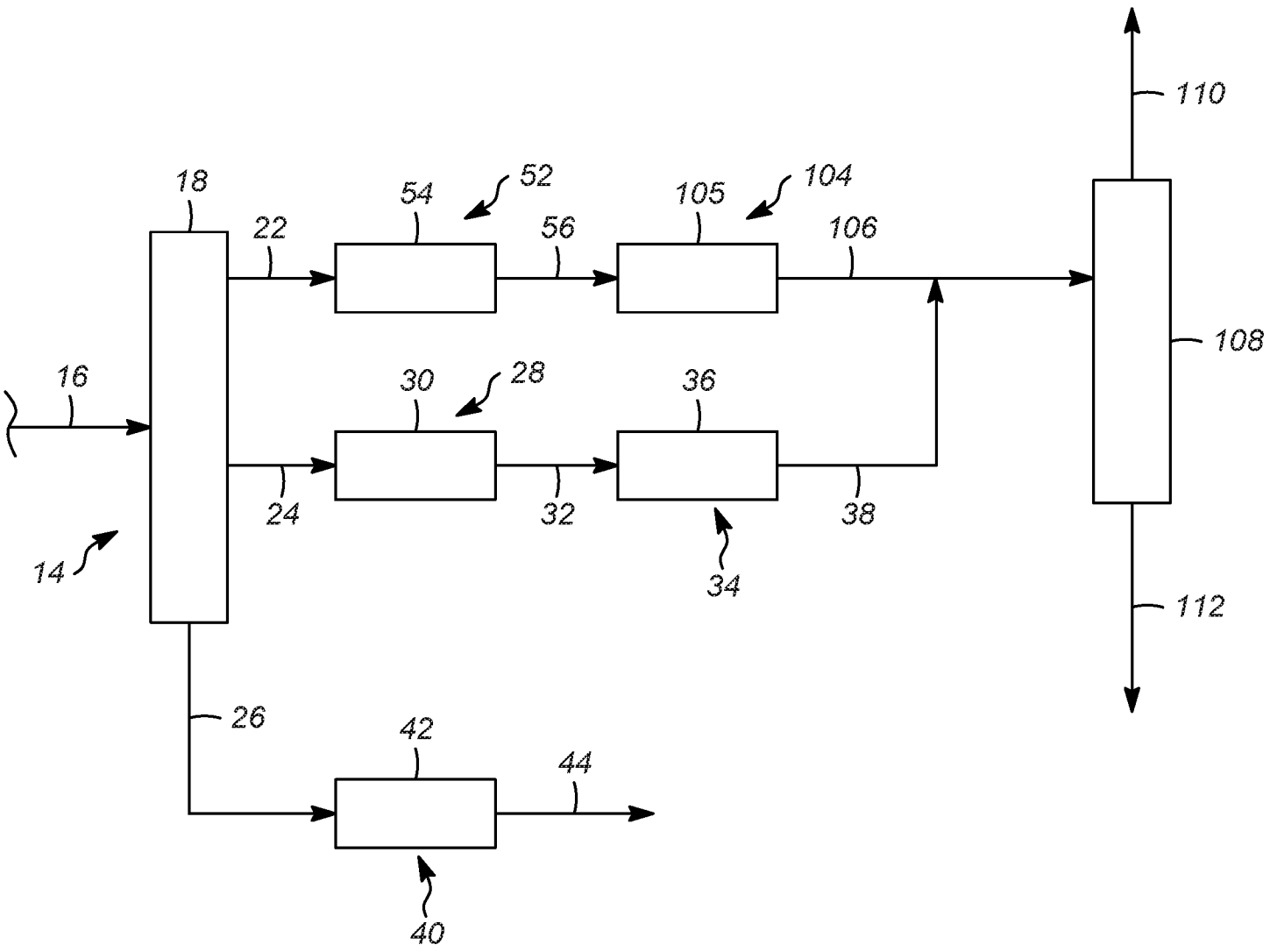
FIG. 4 shows a process flow diagram according to an exemplary process of the present invention.

As shown in FIG. 4, it is contemplated that a separate $C_6$ dehydrogenation zone 104 is included. Specifically, the $C_6$ isomerization effluent 56 is passed to the $C_6$ dehydrogenation zone 104 to dehydrogenate the $C_6$ hydrocarbons (and any $C_5$ hydrocarbons). It is shown that stream 22 is passed to the $C_6$ isomerization zone 52; however, this is merely exemplary and stream 50 (see FIG. 1) could be the feed stream for the isomerization zone. The remaining portions of this embodiment are the same as the others and are hereby incorporated herein as if set forth fully.

The $C_6$ dehydrogenation zone 104 includes a reactor 105 which contains a catalyst to convert a portion of the saturated hydrocarbons in the $C_6$ isomerized effluent 56 to olefins in the presence of hydrogen over a selective dehydrogenation catalyst. The catalyst, conditions, and equipment of the $C_6$ dehydrogenation zone 104 may be the same as the $C_7$ dehydrogenation zone 34, discussed above.

A $C_6$ dehydrogenation effluent 106 may be passed to a stabilizer column 108. The stabilizer column 108 may also receive the $C_7$ dehydrogenation effluent 38. The two streams 106, 38 may be combined before being passed to the stabilizer column 108 to form a combined isomerized dehydrogenation effluent or the two streams 106, 38 maybe combined within the stabilizer column 108. An isomerized dehydrogenation net gas 110 is provided from an overhead of the stabilizer column 108, while a bottoms stream 112 is recovered which contains the $C_7$ hydrocarbons from the $C_7$ dehydrogenation zone, along with the $C_5$ and $C_6$ isomerized and dehydrogenated compounds. Thus, the bottoms stream 112 may be blended in the gasoline pool. Although not depicted as such, the $C_6$ dehydrogenation effluent 106, or the combined streams 106 and 38, or stream 112 may be passed to a selective hydrogenation zone to convert diolefins to mono-olefins. The features of the selective hydrogenation zone are discussed above.

Figure 5:
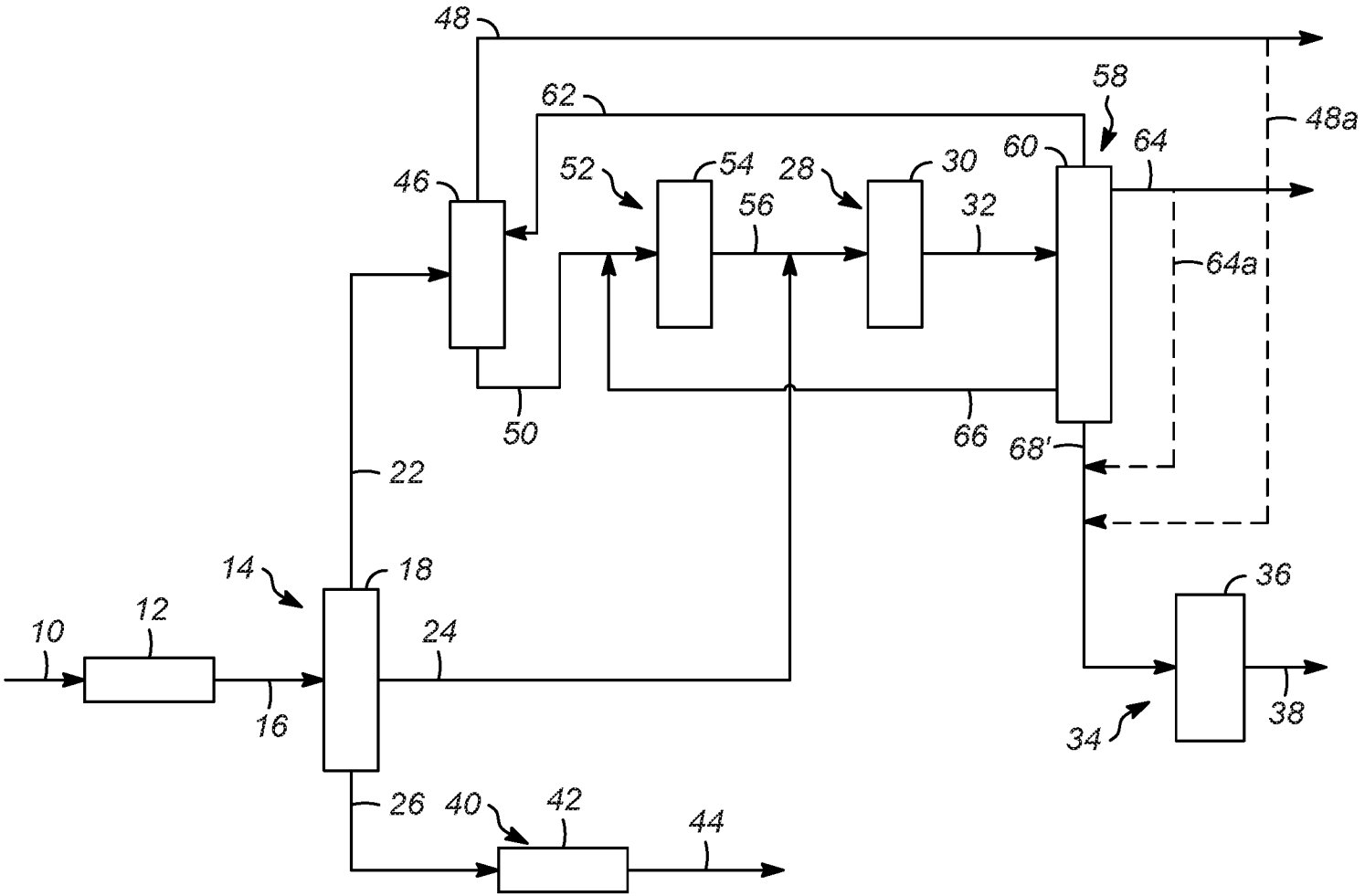
FIG. 5 shows a process flow diagram according to an exemplary process of the present invention.

Turning to FIG. 5, another aspect of the processes the present invention is shown. Specifically, as shown in FIG. 5, the $C_7$ stream 24 from the fractionation column 18 is combined with the $C_6$ isomerization effluent 56, and the combined stream is passed to the reactor 30 in the $C_7$ isomerization zone 28. The $C_7$ isomerization effluent 32 is passed to the deisohexanizer column 60 in the fractionation zone 58. The deisohexanizer column 60 will provide the same streams discussed above with respect to FIGS. 1, 62, 64, and 66; however, the bottoms stream 68' from the deisohexanizer column 60 in this embodiment contains a significant amount of $C_7$+, and thus comprises a $C_7$+ enriched bottoms stream 68'. The $C_7$+ enriched bottoms stream 68' is passed to the dehydrogenation zone 34 to increase the octane value in the $C_7$ dehydrogenation effluent 38. As indicated in FIG. 5, the feed to the dehydrogenation zone 34 may also include the portion 48*a* of stream 48 and/or the portion 64*a* of stream 64. The $C_7$ dehydrogenation effluent 38 is used as a blending component for a gasoline blend, and as mentioned before, may be passed to a selective hydrogenation zone to convert diolefins to mono-olefins before gasoline blending. The remaining portions of this embodiment are the same as the others and are hereby incorporated herein as if set forth fully.

With respect to FIGS. 6 to 9, the octane value of the gasoline blend can be further improved by dehydrogenating the $C_5$ hydrocarbons from the naphtha feed stream 10 (FIG. 1).

Figure 6:
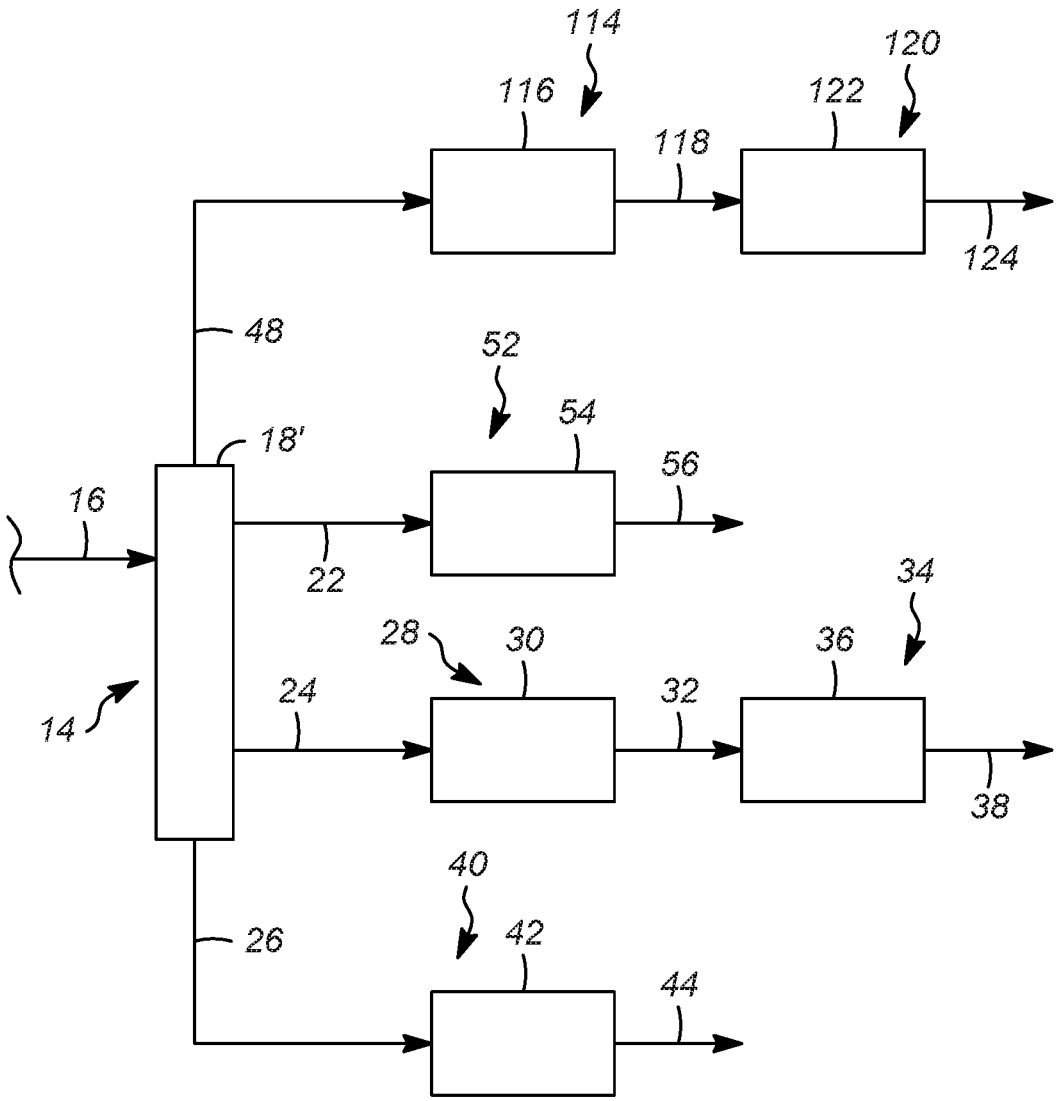
FIG. 6 shows a process flow diagram according to an exemplary process of the present invention.

Accordingly, in FIG. 6 aspects of the present invention in which the $C_5$ portion is treated are shown. Specifically, in the depicted process the fractionation column 18' of the fractionation zone 14 provides the $C_5$ stream 48 comprising $nC_5$ and $iC_5$ hydrocarbons and the $C_6$ stream 22, as well as the $C_7$ stream 24, and the heavy stream 26. The processing of the $C_7$ stream 24, and the heavy stream 26 may be the same as described above in any of the foregoing embodiments and thus those portions are hereby incorporated herein as if set forth fully. Similarly, in FIG. 6, the $C_6$ stream 22 is passed to the $C_6$ isomerization zone 52, and the $C_6$ isomerization effluent 56 may be blended in the gasoline pool.

As depicted in FIG. 6, the $C_5$ stream 48 comprising $nC_5$ and $iC_5$ hydrocarbons from the fractionation column 18' is passed to a $C_5$ isomerization zone 114 that is separate from the $C_6$ isomerization zone 52. The $C_5$ isomerization zone 114 comprises a reactor 116 which includes a catalyst and is operated under conditions to isomerize the normal hydrocarbon in the $C_5$ stream 48. The catalyst and conditions for the $C_5$ isomerization zone 114 may be the same as those described above for the $C_6$ isomerization zone 52.

A $C_5$ isomerization effluent 118 having an increased level of $iC_5$ compared with the $C_5$ stream 48 may be passed to a $C_5$ dehydrogenation zone 120. The $C_5$ dehydrogenation zone 120 comprises a reactor 122 containing a selective dehydrogenation catalyst and operated under conditions discussed above. A $C_5$ isomerized dehydrogenated effluent 124 can be blended with the other streams to provide a gasoline blend. Prior to gasoline blending, the $C_5$ isomerized dehydrogenated effluent 124 can be passed to a selective hydrogenation zone to convert diolefins to mono-olefins.

Figure 7:
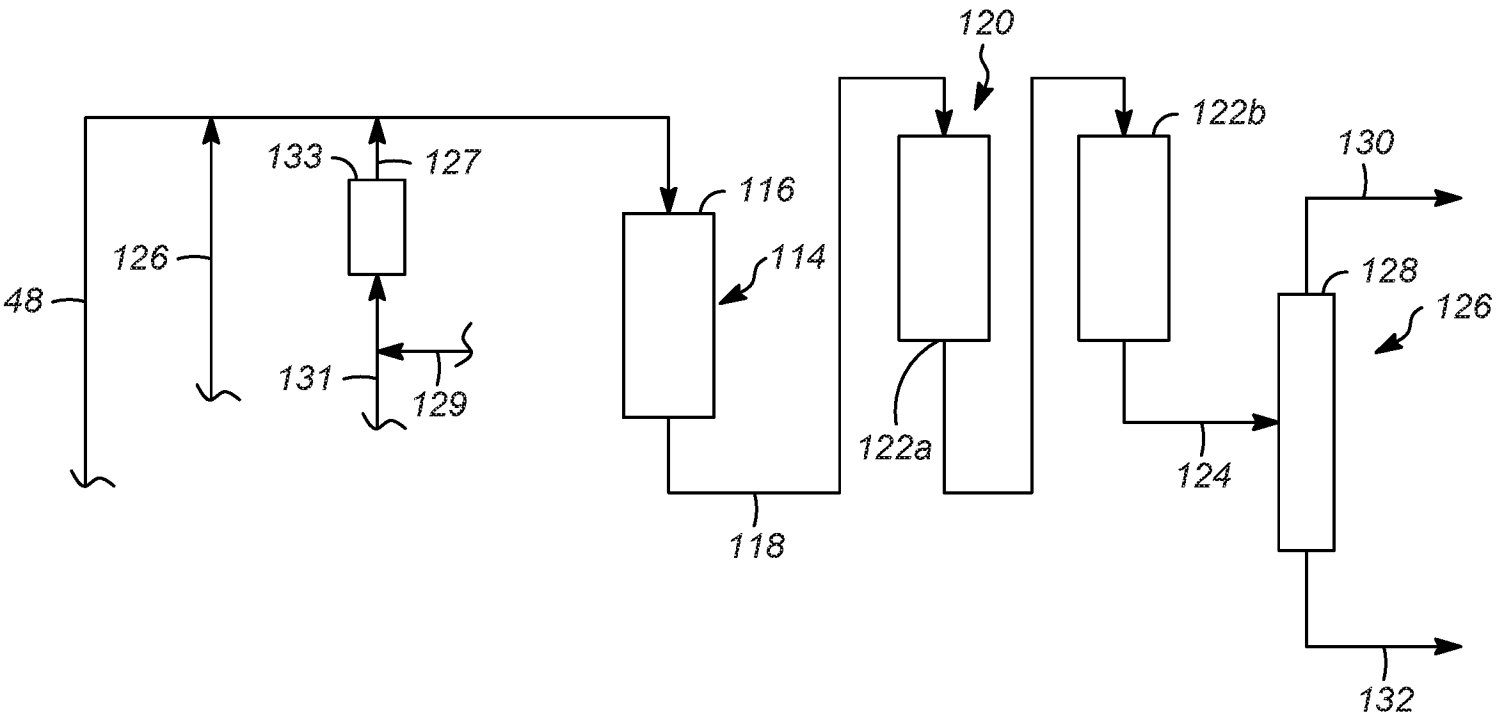
FIG. 7 shows a process flow diagram according to an exemplary process of the present invention.

Turning to FIG. 7, a more detailed process for increasing the octane value of the $C_5$ stream 48 from the fractionation column 18' shown in FIG. 6 is depicted. More specifically, the $C_5$ stream 48, along with an optional slip stream of $C_6$ hydrocarbons 126 and a hydrogen stream containing HCl 127 is passed to the reactor 116 in the $C_5$ isomerization zone 114. The hydrogen stream containing HCl 127 is generated by passing a hydrogen-rich stream 129 and perchloroethylene stream 131 through a reactor 133 containing a catalyst with a group VIII component on a suitable support at 110 to 250° C. (230 to 482° F.) to react the perchloroethylene to form HCl. The HCl in stream 127 can range from about 10-5000 mol-ppm and acts to maintain the chlorided alumina isomerization catalyst activity in reactor 116. By converting the perchloroethylene to HCl in a separate reactor 133 as opposed to in the isomerization reactor 116, the isomerization reactor can be operated at temperatures below the perchloroethylene decomposition temperature of about 105° C. (221° F.). The reactor 116 in the $C_5$ isomerization zone 114 preferably is set to an operating temperature of about 70 to 110° C. (158 to 230° F.), 758 to 3,102 kPa (110 to 450 psig), and 1-5 $hr^{-1}$ LHSV. The lower operating temperature in the isomerization reactor 116 allows an increase in the equilibrium conversion of $nC_5$ to $iC_5$ resulting in desirable higher $iC_5/C_5$ ratios of 78-85% in the $C_5$ stream effluent stream 118. The $C_6$ hydrocarbon slip stream 126 (2 to 5 wt %) is used to suppress disproportionation reactions such as $2iC_5 \rightarrow iC_4 + iC_6$ in the isomerization reactor 116 which are not desired due to the loss of $C_5$+ yield.

The $C_5$ isomerization effluent 118 can be heated (not shown) and then passed to a $C_5$ dehydrogenation zone 120 that includes two reactors 122*a*, 122*b* arranged in series. The use of two reactors 122*a*, 122*b* (with reheating between the stages (not shown)) provides for higher conversions. However, this is merely exemplary and the $C_5$ dehydrogenation zone 120 may comprise a single reactor 122*a*. The operation conditions of the reactors 122*a*, 122*b* include 0 to 345 kPa (0 to 50 psig), 0.5 to 6 hydrogen/hydrocarbon mole ratio, inlet reactor temperatures between 450 to 600° C. (845 to 1112° F.), and 1 to 30 $h^{-1}$ LHSV.

The $C_5$ isomerized dehydrogenated effluent 124 may be passed to a $C_5$ separation zone 126 having, for example, a stripper column 128 which provides a stripper overhead stream 130 comprising $C_4$— and hydrogen, and a stripper bottoms stream 132 comprising $C_5$+ hydrocarbons consisting of $C_5$ paraffins and olefins. The $C_5$ stripper bottoms stream 132 may be blended to provide the gasoline blend. Prior to gasoline blending, the $C_5$ stream 132 can be passed to a selective hydrogenation zone to convert diolefins to mono-olefins.

Figure 8:
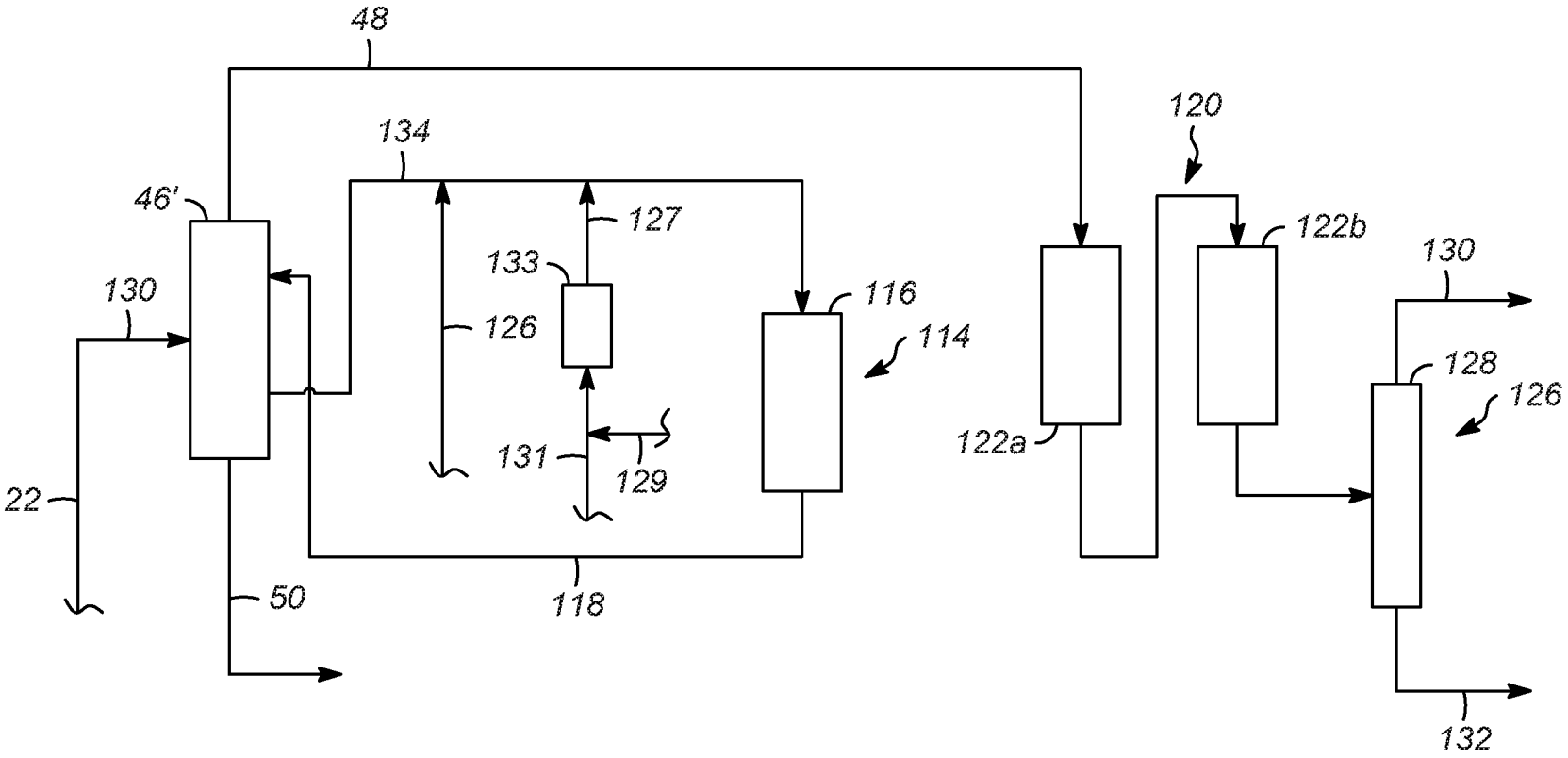
FIG. 8 shows a process flow diagram according to an exemplary process of the present invention; and, FIG. 9 shows a process flow diagram according to an exemplary process of the present invention.

FIG. 8 depicts a process similar to the one in FIG. 7; however in FIG. 8, the fractionation column 18 (see FIG. 1) provides the $C_6$ stream 22, and a column 46' separates the $C_6$ stream 22 into the $C_5$ stream 48 rich in $iC_5$. In contrast to the fractionation column 46 depicted in, for example, FIGS. 1 and 5, in the depicted process, the fractionation column 46' also provides a $C_5$ sidedraw stream 134 rich in $nC_5$. The sidedraw stream 134 rich in $nC_5$ can be then passed, along with the optional slip stream of $C_6$ hydrocarbons 126 and the HCl and hydrogen stream 127, to the reactor 116 in the $C_5$ isomerization zone 114. Again, the reactor 116 is preferably operating at lower temperature described above.

In FIG. 8, the $C_5$ isomerization effluent 118 is passed to the fractionation column 46', and any $iC_5$ is separated into the $C_5$ stream 48 which is sent to the $C_5$ dehydrogenation zone 120 and may be processed as discussed above and shown in FIG. 7. Additionally, the second $C_6$ stream 50 from column 46' may be processed as described in any of the other embodiments shown herein.

Figure 9:
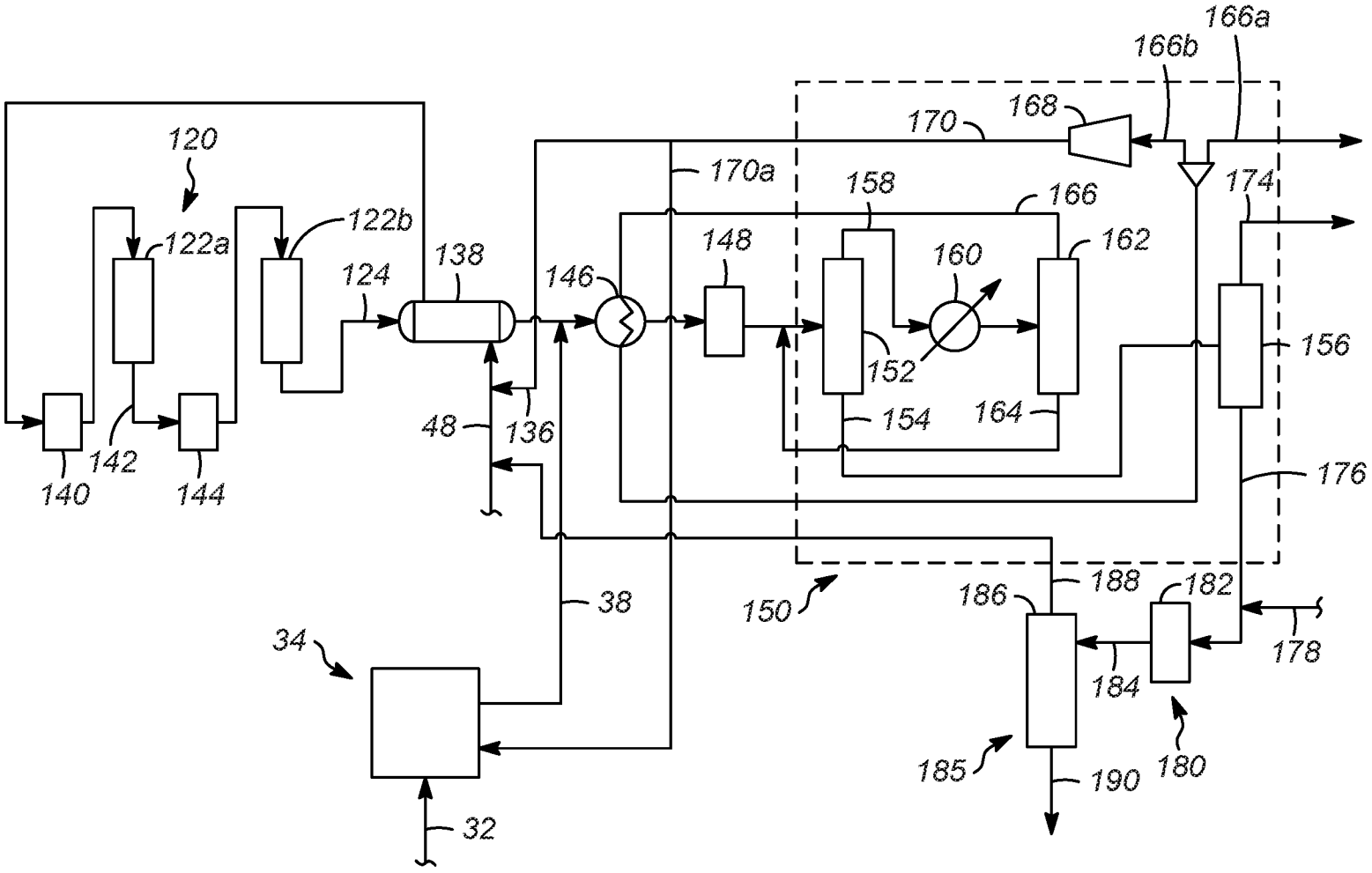

Turning to FIG. 9, another aspect of the present processes is shown for improving the octane value of the $C_5$ component of the naphtha stream 10. In this process, the $C_5$ stream 48, for example, is combined with a hydrogen stream 136 and then passed to a heat exchanger 138 to recover heat from the $C_5$ dehydrogenation effluent 124. From the heat exchanger the stream is heated in first charge heater 140 and then to the first dehydrogenation reactor 122*a*. An intermediate effluent 142 is passed to a second charge heater 144 and then to the second dehydrogenation reactor 122*a*. After passing through the heat exchanger 138, the $C_5$ dehydrogenation effluent 124 may be cooled in a cooler 146 and passed to a dryer section 148 to remove water, and then separated in a separation section 150.

Specifically, in the separation section 150, the $C_5$ dehydrogenation effluent may be passed to a flash vessel 152. A liquid $C_5$ stream 154 from the flash vessel may be passed to a stripper column 156 discussed below. A vapor stream 158 from the flash vessel 152 is chilled in a chiller 160 and then passed to a cold separator vessel 162. A cold separator bottoms steam 164 may be returned to the flash vessel 152. A cold separator overhead 166 may be passed to the cooler 146 to remove heat from the $C_5$ dehydrogenation effluent 124. A portion 166*a* of the cold separator overhead 166 may be recovered as a hydrogen rich stream, while a second portion 166*b* may be compressed in a compressor 168 to provide a compressed hydrogen stream 170 that may be used as the hydrogen stream 136 combined with the $C_5$ stream 48.

Returning to the stripper column 156, an off-gas stream 174 comprising $C_4$— hydrocarbons can be recovered, while a bottoms stream 176 may be passed, with a hydrogen stream 178, to a selective hydrogenation zone 180 having a reactor 182 containing a catalyst and being operated under conditions to selectively hydrogenate di-olefins in the bottoms stream 176 to mono-olefins. The effluent 184 from the selective hydrogenation zone 180 may be used as a gasoline blending component. Alternatively, the effluent 184 can be separated in a fractionation zone 185 having, for example, a $C_5$ splitter column 186, which will provide a $C_5$ splitter overhead 188 comprising $iC_5$ which can be recycled to the dehydrogenation zone by being combined with the $C_5$ stream 48. A bottoms stream 190 from the $C_5$ splitter column 186 can be blended as a gasoline component.

Additionally, it is further contemplated that a portion 170*a* of the compressed hydrogen stream 170 may be passed to the $C_7$ dehydrogenation zone 34. The $C_7$ dehydrogenation effluent 38 may be combined with the $C_5$ dehydrogenation effluent 124, downstream of the heat exchanger 138, to be separated in the separation section 150. Thus, the bottoms stream 176 will include the high octane $C_7$ components, as well as $C_5$ and some $C_6$ components that can be blended to form the gasoline blend, or further processed as discussed above.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention. Additionally, it should be appreciated that the number of reactors 30, 36, 54, 105, 116, 120, 122*a*, 122*b* as shown in Figures can be one or more and that the blocks shown are only representative.

SPECIFIC EMBODIMENTS

While the following is described in conjunction with specific embodiments, it will be understood that this description is intended to illustrate and not limit the scope of the preceding description and the appended claims.

A first embodiment of the invention is a process for production of a gasoline blend, the process comprising separating, a naphtha feed into a $C_5$ stream comprising $iC_5$, a stream comprising $C_6$ hydrocarbons, a $C_7$ stream comprising $C_7$ hydrocarbons, and a heavy stream comprising $C_8$ and heavier hydrocarbons; isomerizing, in a $C_6$ isomerization zone at isomerization conditions, at least a portion of the stream comprising $C_6$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and forming the gasoline blend by blending at least to the $C_5$ stream comprising $iC_5$, the $C_6$ isomerization effluent, the $C_7$ isomerized dehydrogenation effluent, and the reformate stream. An embodiment of the invention is one, any or all of prior embodiments in this paragraph up through the first embodiment in this paragraph, wherein the $C_7$ dehydrogenation zone is operated on a feed stream with less than about 1.5 wt % cyclohexane and less than about 7.5 wt % methylcyclohexane. An embodiment of the invention is one, any or all of prior embodiments in this paragraph up through the first embodiment in this paragraph wherein a portion of the $C_7$ isomerization effluent bypasses the dehydrogenation zone. An embodiment of the invention is one, any or all of prior embodiments in this paragraph up through the first embodiment in this paragraph further comprising separating a $C_4$— stream from the $C_7$ isomerization effluent; and combining the $C_4$— stream with a portion of the $C_6$ isomerization effluent. An embodiment of the invention is one, any or all of prior embodiments in this paragraph up through the first embodiment in this paragraph further comprising separating a $C_7$ dehydrogenation net gas comprising $H_2$, $C_1$, and $C_2$ hydrocarbons from the $C_7$ isomerized dehydrogenation effluent; passing the $C_7$ dehydrogenation net gas to the reforming zone. An embodiment of the invention is one, any or all of prior embodiments in this paragraph up through the first embodiment in this paragraph further comprising dehydrogenating, in a $C_6$ dehydrogenation zone, at least a portion of the $C_6$ isomerization effluent to form a $C_6$ isomerized dehydrogenation effluent; combining the $C_6$ isomerized dehydrogenation effluent and the $C_7$ isomerized dehydrogenation effluent to form a combined isomerized dehydrogenation effluent; and, separating an isomerized dehydrogenation net gas from the combined isomerized dehydrogenation effluent. An embodiment of the invention is one, any or all of prior embodiments in this paragraph up through the first embodiment in this paragraph further comprising separating the $C_6$ isomerization effluent into at least an $iC_6$ stream; and, dehydrogenating the $iC_6$ stream with the $C_7$ isomerization effluent in the $C_7$ dehydrogenation zone. An embodiment of the invention is one, any or all of prior embodiments in this paragraph up through the first embodiment in this paragraph further comprising combining the $C_5$ stream comprising $iC_5$ with the $C_7$ isomerization effluent; and, dehydrogenating the $C_5$ stream, in the $C_7$ dehydrogenation zone, with the $C_7$ isomerization effluent. An embodiment of the invention is one, any or all of prior embodiments in this paragraph up through the first embodiment in this paragraph further comprising combining the $C_5$ stream comprising $iC_5$ with the $C_7$ isomerization effluent; and, dehydrogenating the $C_5$ stream, in the $C_7$ dehydrogenation zone, with the $C_7$ isomerization effluent. An embodiment of the invention is one, any or all of prior embodiments in this paragraph up through the first embodiment in this paragraph further comprising combining the $C_7$ stream comprising $C_7$ hydrocarbons with the $C_6$ isomerization effluent and passing the combined stream to the $C_7$ isomerization zone. An embodiment of the invention is one, any or all of prior embodiments in this paragraph up through the first embodiment in this paragraph further comprising separating the $C_7$ isomerization effluent into at least one $C_7$ isomerized stream; and, passing the $C_7$ isomerized stream to the $C_7$ dehydrogenation zone. An embodiment of the invention is one, any or all of prior embodiments in this paragraph up through the first embodiment in this paragraph, wherein the $C_5$ stream comprises $nC_5$ and $iC_5$ hydrocarbons, and wherein the process further comprises isomerizing the $C_5$ stream in a $C_5$ isomerization zone to produce an effluent with an increased level of $iC_5$ hydrocarbons; passing the $C_5$ isomerized effluent to a $C_5$ dehydrogenation zone configured to provide a $C_5$ isomerized dehydrogenated effluent; and, blending the $C_5$ isomerized dehydrogenated effluent with the at least two streams to form the gasoline blend. An embodiment of the invention is one, any or all of prior embodiments in this paragraph up through the first embodiment in this paragraph, wherein the stream comprising $C_6$ hydrocarbons includes $nC_5$, and the process further comprising separating a portion of the $C_6$ isomerization effluent into at least an $iC_5$ rich stream; and, dehydrogenating, in an $iC_5$ dehydrogenation zone, the $iC_5$ rich stream to provide an $iC_5$ dehydrogenation effluent comprising $iC_5$ olefins. An embodiment of the invention is one, any or all of prior embodiments in this paragraph up through the first embodiment in this paragraph further comprising separating a recycle stream from the $iC_5$ dehydrogenation effluent, the recycle stream comprising unconverted $iC_5$ paraffins; and passing the recycle stream back to the $iC_5$ dehydrogenation zone. An embodiment of the invention is one, any or all of prior embodiments in this paragraph up through the first embodiment in this paragraph wherein the $iC_5$ dehydrogenation zone comprises two or more reactors. An embodiment of the invention is one, any or all of prior embodiments in this paragraph up through the first embodiment in this paragraph further comprising separating, in a deisopentanizer column, the $C_5$ stream into an overhead stream comprising $iC_5$ and an $nC_5$ rich stream, wherein the $nC_5$ rich stream is passed to the $C_5$ isomerization zone; and, separating the $C_5$ isomerized effluent in the deisopentanizer column; and, wherein the overhead stream comprising $iC_5$ is passed to the dehydrogenation zone. An embodiment of the invention is one, any or all of prior embodiments in this paragraph up through the first embodiment in this paragraph wherein the $C_7$ stream comprising $C_7$ hydrocarbons further comprises at least one hydrocarbon selected from the group consisting of $C_5$, $C_6$, and $C_8$ paraffins, iso-paraffins and cyclopentanes. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

A second embodiment of the invention is a process for production of a gasoline blend, the process comprising separating, a naphtha feed into a $C_5$ stream comprising $iC_5$, a stream comprising $C_6$ and $nC_5$ hydrocarbons, a $C_7$ stream comprising $C_7$ hydrocarbons, and a heavy stream comprising $C_8$ and heavier hydrocarbons; isomerizing, in a $C_6$ isomerization zone at isomerization conditions, the stream comprising $C_6$ and $nC_5$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and forming the gasoline blend by blending the $C_5$ stream comprising $iC_5$, a portion of the $C_6$ isomerization effluent, the $C_7$ isomerized dehydrogenation effluent, and the reformate stream.

A third embodiment of the invention is a process for production of a gasoline blend, the process comprising separating, a naphtha feed into a $C_5$ stream comprising $nC_5$ and $iC_5$, a stream comprising $C_6$ hydrocarbons, a $C_7$ stream comprising $C_7$ hydrocarbons, and a heavy stream comprising $C_8$ and heavier hydrocarbons; isomerizing the $C_5$ stream in a $C_5$ isomerization zone to produce an effluent with an increased level of $iC_5$ hydrocarbons; passing the $C_5$ isomerized effluent to a $C_5$ dehydrogenation zone configured to provide a $C_5$ isomerized dehydrogenated effluent; isomerizing, in a $C_6$ isomerization zone at isomerization conditions, at least a portion of the stream comprising $C_6$ hydrocarbons to form a $C_6$ isomerization effluent; isomerizing, in a $C_7$ isomerization zone at isomerization conditions, the $C_7$ stream comprising $C_7$ hydrocarbons to form a $C_7$ isomerization effluent; dehydrogenating, in a $C_7$ dehydrogenation zone, at least a portion of the $C_7$ isomerization effluent to form a $C_7$ isomerized dehydrogenation effluent comprising $C_7$ olefins; reforming, in a reforming zone under reforming conditions, the heavy stream to form a reformate stream; and, forming the gasoline blend by blending at least a portion of the $C_5$ isomerized dehydrogenated effluent, a portion of the $C_6$ isomerization effluent, and the $C_7$ isomerized dehydrogenation effluent.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for production of a gasoline blend, the process comprising:

separating a naphtha feed into a C5 stream comprising iC5, a stream comprising C6 hydrocarbons, a C7 stream comprising C7 hydrocarbons, and a heavy stream comprising C8 and heavier hydrocarbons;

isomerizing, in a C6 isomerization zone at isomerization conditions, at least a portion of the stream comprising C6 hydrocarbons to form a C6 isomerization effluent;

isomerizing, in a C7 isomerization zone at isomerization conditions, the C7 stream comprising C7 hydrocarbons to form a C7 isomerization effluent;

dehydrogenating, in a C7 dehydrogenation zone, at least a portion of the C7 isomerization effluent to form a C7 isomerized dehydrogenation effluent comprising C7 olefins;

reforming, in a reforming zone under reforming conditions, the heavy stream to form a reformate stream; and forming the gasoline blend by blending at least two of: the C5 stream comprising iC5, the C6 isomerization effluent, the C7 isomerized dehydrogenation effluent, and the reformate stream.

2. The process of claim 1, wherein the C7 dehydrogenation zone is operated on a feed stream with less than about 1.5 wt % cyclohexane and less than about 7.5 wt % methylcyclohexane.

3. The process of claim 1 wherein a portion of the C7 isomerization effluent bypasses the dehydrogenation zone.

4. The process of claim 1 further comprising:

separating a C4-stream from the C7 isomerization effluent; and combining the C4-stream with a portion of the C6 isomerization effluent.

5. The process of claim 4 further comprising:

separating a C7 dehydrogenation net gas comprising H2, C1, and C2 hydrocarbons from the C7 isomerized dehydrogenation effluent;

passing the C7 dehydrogenation net gas to the reforming zone.

6. The process of claim 1 further comprising:

dehydrogenating, in a C6 dehydrogenation zone, at least a portion of the C6 isomerization effluent to form a C6 isomerized dehydrogenation effluent;

combining the C6 isomerized dehydrogenation effluent and the C7 isomerized dehydrogenation effluent to form a combined isomerized dehydrogenation effluent; and, separating an isomerized dehydrogenation net gas from the combined isomerized dehydrogenation effluent.

7. The process of claim 1 further comprising:

separating the C6 isomerization effluent into at least an iC6 stream; and, dehydrogenating the iC6 stream with the C7 isomerization effluent in the C7 dehydrogenation zone.

8. The process of claim 7 further comprising:

combining the C5 stream comprising iC5 with the C7 isomerization effluent; and, dehydrogenating the C5 stream, in the C7 dehydrogenation zone, with the C7 isomerization effluent.

9. The process of claim 1 further comprising:

combining the C5 stream comprising iC5 with the C7 isomerization effluent; and, dehydrogenating the C5 stream, in the C7 dehydrogenation zone, with the C7 isomerization effluent.

10. The process of claim 1 further comprising:

combining the C7 stream comprising C7 hydrocarbons with the C6 isomerization effluent and passing the combined stream to the C7 isomerization zone.

11. The process of claim 10 further comprising:

separating the C7 isomerization effluent into at least one C7 isomerized stream; and, passing the C7 isomerized stream to the C7 dehydrogenation zone.

12. The process of claim 1, wherein the C5 stream comprises nC5 and iC5 hydrocarbons, and wherein the process further comprises:

isomerizing the C5 stream in a C5 isomerization zone to produce an effluent with an increased level of iC5 hydrocarbons;

passing the C5 isomerized effluent to a C5 dehydrogenation zone configured to provide a C5 isomerized dehydrogenated effluent; and, blending the C5 isomerized dehydrogenated effluent with the at least two streams to form the gasoline blend.

13. The process of claim 1, wherein the stream comprising C6 hydrocarbons includes nC5, and the process further comprising:

separating a portion of the C6 isomerization effluent into at least an iC5 rich stream; and, dehydrogenating, in an iC5 dehydrogenation zone, the iC5 rich stream to provide an iC5 dehydrogenation effluent comprising iC5 olefins.

14. The process of claim 13 further comprising:

separating a recycle stream from the iC5 dehydrogenation effluent, the recycle stream comprising unconverted iC5 paraffins; and passing the recycle stream back to the iC5 dehydrogenation zone.

15. The process of claim 14 wherein the iC5 dehydrogenation zone comprises two or more reactors.

16. The process of claim 13 further comprising:

separating, in a deisopentanizer column, the C5 stream into an overhead stream comprising iC5 and an nC5 rich stream, wherein the nC5 rich stream is passed to the C5 isomerization zone; and, separating the C5 isomerized effluent in the deisopentanizer column; and, wherein the overhead stream comprising iC5 is passed to the dehydrogenation zone.

17. The process of claim 1 wherein the C7 stream comprising C7 hydrocarbons further comprises at least one hydrocarbon selected from the group consisting of C5, C6, and C8 paraffins, iso-paraffins and cyclopentanes.

18. A process for production of a gasoline blend, the process comprising:

separating a naphtha feed into a C5 stream comprising iC5, a stream comprising C6 and nC5 hydrocarbons, a C7 stream comprising C7 hydrocarbons, and a heavy stream comprising C8 and heavier hydrocarbons;

isomerizing, in a C6 isomerization zone at isomerization conditions, the stream comprising C6 and nC5 hydrocarbons to form a C6 isomerization effluent;

isomerizing, in a C7 isomerization zone at isomerization conditions, the C7 stream comprising C7 hydrocarbons to form a C7 isomerization effluent;

dehydrogenating, in a C7 dehydrogenation zone, at least a portion of the C7 isomerization effluent to form a C7 isomerized dehydrogenation effluent comprising C7 olefins;

reforming, in a reforming zone under reforming conditions, the heavy stream to form a reformate stream; and forming the gasoline blend by blending the C5 stream comprising iC5, a portion of the C6 isomerization effluent, the C7 isomerized dehydrogenation effluent, and the reformate stream.

19. A process for production of a gasoline blend, the process comprising:

separating a naphtha feed into a C5 stream comprising nC5 and iC5, a stream comprising C6 hydrocarbons, a C7 stream comprising C7 hydrocarbons, and a heavy stream comprising C8 and heavier hydrocarbons;

isomerizing the C5 stream in a C5 isomerization zone to produce an effluent with an increased level of iC5 hydrocarbons;

passing the C5 isomerized effluent to a C5 dehydrogenation zone configured to provide a C5 isomerized dehydrogenated effluent;

isomerizing, in a C6 isomerization zone at isomerization conditions, at least a portion of the stream comprising C6 hydrocarbons to form a C6 isomerization effluent;

isomerizing, in a C7 isomerization zone at isomerization conditions, the C7 stream comprising C7 hydrocarbons to form a C7 isomerization effluent;

dehydrogenating, in a C7 dehydrogenation zone, at least a portion of the C7 isomerization effluent to form a C7 isomerized dehydrogenation effluent comprising C7 olefins;

reforming, in a reforming zone under reforming conditions, the heavy stream to form a reformate stream; and forming the gasoline blend by blending at least a portion of the C5 isomerized dehydrogenated effluent, a portion of the C6 isomerization effluent, and the C7 isomerized dehydrogenation effluent.

* * * * *